United States Patent [19]

Theurer et al.

[11] Patent Number: 4,630,541

[45] **Date of Patent: * Dec. 23, 1986**

[54] MOBILE TRACK LEVELING, LINING AND TAMPING MACHINE

[75] Inventors: Josef Theurer, Vienna; Johann Hansmann, Klosterneuburg, both of Austria

[73] Assignee: Franz Plasser Bahnbaumaschinen-Industriegesellschaft m.b.H., Vienna, Austria

[ * ] Notice: The portion of the term of this patent subsequent to Aug. 13, 2002 has been disclaimed.

[21] Appl. No.: 618,122

[22] Filed: Jun. 7, 1984

[30] Foreign Application Priority Data

Aug. 19, 1983 [AT] Austria ..... 2981/83

[51] Int. Cl.[4] ..... E01B 27/17

[52] U.S. Cl. ..... 104/7.2; 104/12

[58] Field of Search ..... 104/2, 7 R, 7 B, 12; 105/157 R

[56] References Cited

U.S. PATENT DOCUMENTS

| | | | |
|---|---|---|---|
| 3,469,534 | 9/1969 | Plasser et al. | 104/7 B |
| 3,494,297 | 2/1970 | Plasser et al. | 104/7 B |
| 3,595,170 | 7/1971 | Plasser et al. | 104/12 |
| 3,744,428 | 7/1973 | Plasser et al. | 104/12 |
| 3,795,198 | 3/1974 | Plasser et al. | 104/12 |
| 4,165,694 | 8/1979 | Theurer | 104/7 B |
| 4,249,468 | 2/1981 | Klaar | 104/12 |
| 4,323,013 | 4/1982 | Theurer | 104/7 B |
| 4,356,771 | 11/1982 | Theurer | 104/7 B |
| 4,502,391 | 3/1985 | Hurni | 105/157 R |

FOREIGN PATENT DOCUMENTS

| | | | |
|---|---|---|---|
| 363982 | 9/1981 | Austria . | |
| 2070670 | 9/1981 | United Kingdom . | |
| 2077821 | 12/1981 | United Kingdom | 104/7 B |

OTHER PUBLICATIONS

09-CSM advertisement, "Der Eisenbahningenieur", No. 6, Jun. 1983.

*Primary Examiner*—Randolph A. Reese
*Attorney, Agent, or Firm*—Kurt Kelman

[57] ABSTRACT

A mobile machine for leveling, lining and tamping a track has a main frame supported on undercarriages for continuous movement in an operating direction, a power plant and operating controls carried by the main frame, and an elongated subframe pivotally and longitudinally adjustably connected to the main frame, the subframe having two ends and being arranged ahead of one of the undercarriages supporting the main frame, respective undercarriages supporting the subframe ends. Tamping heads are mounted on the subframe between the respective undercarriages for tamping ballast in intermittent tamping cycles under respective ties at points of intersection of the two rails and the respective ties. A track lifting and lining unit is associated with the two rails mounted on the subframe ahead of the tamping heads and arranged on the subframe between the respective undercarriages. A longitudinally adjustable coupling device pivotally connects the elongated subframe to the main frame whereby the subframe moves with the main frame while being longitudinally adjusted in relation thereto.

20 Claims, 5 Drawing Figures

MOBILE TRACK LEVELING, LINING AND TAMPING MACHINE

The present invention relates to improvements in a mobile machine for leveling, lining and tamping a track consisting of two rails fastened to successive ties resting on ballast, wherein a main frame is supported on undercarriages for continuous movement in an operating direction, a power plant and operating control means are carried by the main frame, and a subframe pivotally and longitudinally adjustably connected to the main frame and arranged ahead of one of the undercarriages supporting the main frame, in the operating direction. Tamping means for tamping ballast in intermittent tamping cycles under respective ties at points of intersection of the two rails and the respective ties, and track lifting and lining means associated with the two rails ahead of the tamping means, in the operating direction, are mounted on the subframe between two undercarriages. Track leveling and lining reference systems are associated with the track lifting and lining means.

In the development of continuously moving track leveling, lining and tamping machines, it is desirable to overcome or at least to reduce such phenomena necessarily connected with the stop-and-go advancement of the tamping heads between tamping cycles as the high stresses to which essential structural components of the machine are subjected due to the constant repetition of acceleration and braking as well as the physical stresses on the operating personnel due to the alternatingly accelerating and decelerating forces of the heavy masses moving along the track. Various structures have been proposed to enable mobile tampers to advance continuously along the track while performing intermittent tamping cycles but none of them has been successful in practical track maintenance operations.

U.S. Pat. No. 4,249,468, dated Feb. 10, 1981, discloses a mobile track tamping machine for tamping ballast under successive ties during the continuous advancement of the machine. The machine comprises a tamping tool carrier vertically adjustably mounted on the machine frame between a rear undercarriage and a track lifting and lining unit, the tamping tool carrier being rotatably about a horizontal axis with tamping tools projecting therefrom like spokes for sequential immersion in successive cribs. Such a machine would require a very precise synchronization between the machine forward drive and the rotary drive of the tamping tool carrier to center the tamping tools properly in irregularly spaced cribs and to enable the tamping tools in the adjacent cribs to be suitably reciprocated for tamping the ballast under an interposed tie. Also, a relatively massive carrier is required for the numerous tamping tools mounted thereon. A machine of this type has not been built.

U.S. Pat. No. 3,795,198, dated Mar. 5, 1974, also discloses a continuously advancing track tamper. In this machine, the tamping head associated with each rail is longitudinally displaceable along a guide on the machine frame and a track lifting unit is mounted on the machine frame ahead of the tamping heads. While the machine frame with the track lifting unit advances continuously, the tamping heads must remain stationary during each tamping cycle and must then be rapidly driven forwardly along their guides until the tamping tools are centered over the next tie to be tamped. This machine may use standard tamping heads. The machine frame must be massive to enable it to sustain not only the loads of the tamping heads with their guides and drives but also the operating forces of the vibratory tamping tools and the track lifting unit. A machine of this type also has not been built.

A commercially very successful track working machine has been disclosed in U. S. Pat. No. 4,356,771, dated Nov. 2, 1982, wherein a self-propelled and intermittently advancing standard track leveling, lining and tamping machine incorporating leveling and lining reference systems is coordinated with a self-propelled control vehicle which advances non-stop. The control vehicle is coupled to the machine by a distance monitoring device and the machine operation may be effected from an operator's cab on the control vehicle and observed there by television. The operator effecting the remote control works more comfortably because he is not subject to the stop-and-go impacts of the machine nor is he subject to the vibrations of the working forces of the tamping, lifting and lining tools. However, the provision of the additional control vehicle, with the required remote control and television devices, makes this installation so expensive that it can be economically used only for special track work, such as laying of new track or rehabilitation of track for high-speed traffic, in which the uniformity of the tie positioning and of the ballast condition permits the operation to be highly automated. This enables the operator on the control vehicle to effectuate his control functions on the basis of the television picture received from the operating area of the machine and without requiring the assistance of the operator riding on the machine.

UK patent application No. 2,070,670, published Sept. 9, 1981, discloses a mobile ballast cleaning machine equipped with a track lifting device. A number of waste material carrying cars are coupled to the ballast cleaning machine and a track tamper with two additional track lifting devices is arranged between the ballast cleaning machine and the waste material carrying cars, a waste material conveying arrangement extending between the ballast cleaning machine and the waste material carrying cars and bridging over the tamper. The tamping heads associated with the respective track rails are longitudinally displaceably mounted on the tamper to enable them to advance intermittently while the train consisting of the ballast cleaning machine, the tamper and the waste material carrying cars moves non-stop. This work train makes it possible to lift the track by successively arranged lifting devices to a desired level in a single pass while cleaning the ballast. At the provisional level, the track is fixed by tamping the ballast under the ties and the successive lifting strokes are small enough to avoid undue flexing stresses on the track rails at any one lifting point. The track tamper frame remains subject to absorbing all operating forces and the operator on the tamper is subject to all the stresses of the operation.

U.S. Pat. No. 3,744,428, dated July 10, 1973, discloses a track leveling and tamping machine with a plurality of tamping units whose distance from each other may be changed, each tamping unit being mounted on a respective machine frame portion which are pivotally coupled together.

Austrian Pat. No. 363,982, published Sept. 10, 1981, discloses a standard mobile track leveling, lining and tamping machine whose operating tools are mounted on an elongated machine frame between two undercarriages supporting the machine frame. The track leveling and lining unit may be longitudinally adjusted by a hydraulic cylinder-and-piston device.

U.S. Pat. No. 4,534,295 and application Ser. No. 498,261, filed May 26, 1983, disclose a mobile track leveling, lining and tamping machine of the type initially described hereinabove, and a model of such a non-stop advancing machine has been successfully built and operated, as reflected in an advertisement of the 09-CSM in "Der Eisenbahningenieur", No. 6, June 1983. This machine for the first time met the practical requirements and solved the problems encountered in the operation of such a machine. A substantial part of the weight and operating forces of the tamping, track lifting and lining means is transmitted to the track through the further undercarriage supporting the subframe means for stop-and-go movement while the heavy machine frame advances non-stop so that the latter is subjected to substantially smaller static and dynamic loads than in the machines proposed in the above-identified patents, wherein the individual tamping heads are longitudinally displaced on guides along the machine frame. At the same time, heavy impacts and vibrations are kept from the operator's cab on the machine frame so that the working conditions of the operator are considerably enhanced. This practical non-stop tamper has opened up a number of developmental possibilities and has initiated a new generation of track working machines.

It is the primary object of this invention to improve this new non-stop track leveling, lining and tamping machine so as to provide even more comfort for the operating personnel of the machine.

The above and other objects and advantages are accomplished in a mobile track leveling, lining and tamping machine of the first-described type with an elongated subframe having two ends and being arranged ahead of one of the undercarriages supporting the main frame, in the operating direction, and respective undercarriages supporting the subframe ends, the tamping means and the track lifting and lining means being arranged on the subframe between the respective undercarriages. A longitudinally adjustable coupling device pivotally connects the elongated subframe to the main frame whereby the subframe moves with the main frame while being longitudinally adjusted in relation thereto.

This arrangement provides maximum comfort for the operating personnel and subjects the operators and structural components of the machine to minimum wear and stress. Since the subframe on which all the operating tools are mounted is fully independently supported on the track by its own undercarriages, the main frame is completely relieved of the weight and working stresses of these tools. This also enhances the accuracy of the work because the continuous advancement of the main frame is free of all shocks and vibrations, which advantageously affects the vibration-sensitive reference systems and indicating instruments at the controls in the operator's cab on the main frame, making a more precise setting of all controls possible. At the same time, the continuously advancing undercarriages of the heavy main frame exert a uniform load on the track, which tends to stabilize the corrected track and leads to a more uniform ballast compaction.

The machine of this invention also makes it possible to use a subframe of very simple construction with standard undercarriages and provides a favorable distribution of the entire weight of the machine over a total of four undercarriages. Therefore, such a machine, even when equipped with heavy twin tamping heads for the simultaneous tamping of two successive ties, may be used on branch lines whose track will take only relatively low axle loads. Also, since the main machine frame is not subjected to the weight and stresses of the tamping, track lifting and lining means, it may be less massively constructed than conventional tamper frames to meet the requirements of its own weight and to withstand any tension and impact forces to which it may be subjected when it is part of a train.

The above and other objects, advantages and features of the invention will become more apparent in the following description of certain now preferred embodiments, taken in conjunction with the accompanying, partly schematic drawing wherein FIG. 1 is a side elevational view of a mobile track leveling, lining and tamping machine according to the present invention; , FIG. 2 is a somewhat diagrammatic top view of the machine;

Figure 1:
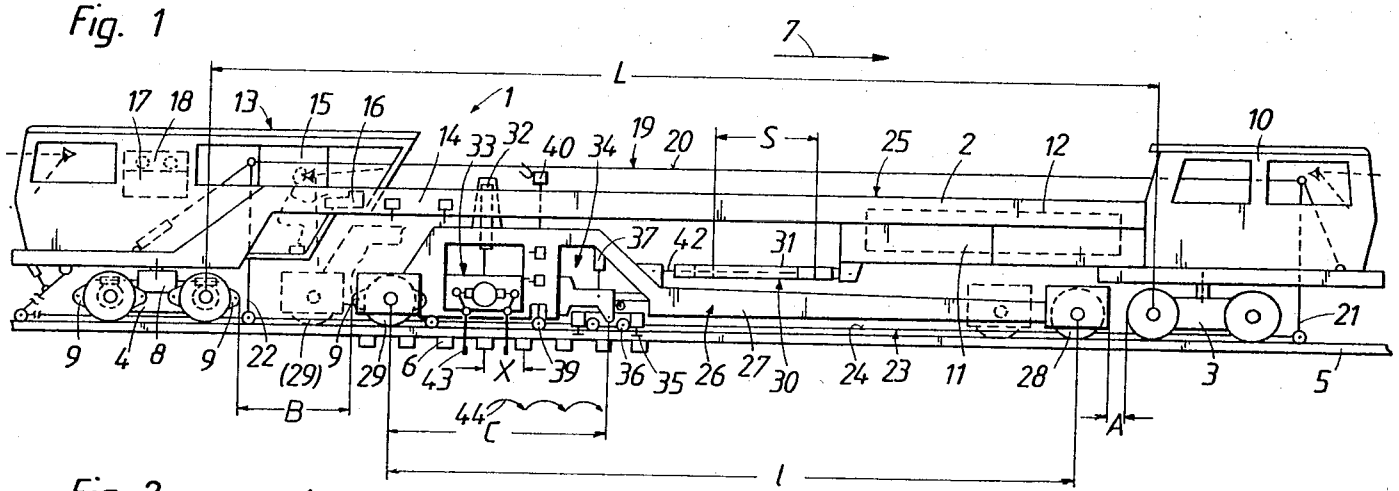
Figure 2:
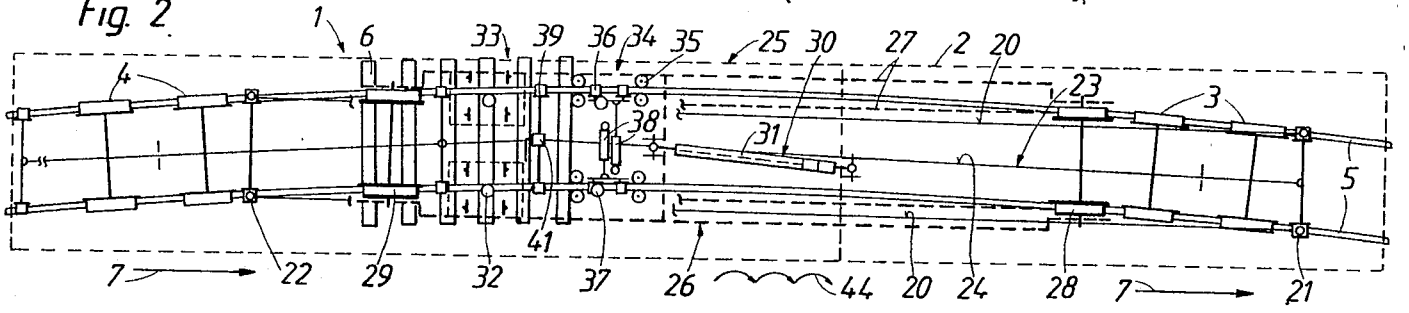

Referring now to the drawing and first to FIGS. 1 and 2, there is shown mobile machine 1 for leveling, lining and tamping a track consisting of two rails 5 fastened to successive ties 6 resting on ballast. The machine comprises elongated main frame 2 supported on undercarriages 3 and 4 for continuous movement in an operating direction indicated by arrow 7. The illustrated undercarriages are widely spaced swivel trucks supporting the front and rear ends of main machine frame 2. Drive 8 operates on rear swivel truck 4 to propel the main frame continuously in the operating direction. The rear swivel truck also has pneumatic brake 9. The front end of the main frame carries operator's cab 10 and box-shaped part 11 of the main frame adjacent to the cab houses the power plant and operating control means 12. Another operator's cab 13 is mounted at the rear end of the main machine frame and a forward portion of this cab between two longitudinal beams 14 of main frame 2 has a large glass window in front of operating stand 15 equipped with drive and control panel 16 which contains central control 17 and indicating instrument 18.

Machine 1 is equipped with leveling reference system 19 comprising respective reference wires 20 associated with N rails 5, the front and rear reference wire ends being respectively guided by track level and line sensing elements 21 and 22 in uncorrected and leveled track sections. The machine is further equipped with lining reference system 23 embodied in reference wire 24 extending centrally between the rails between front and rear sensing elements 21, 22.

This main frame advances continuously at a uniform speed in the operating direction to constitute mother vehicle 25 of the machine and carries the power plant, controls and operator(s). Elongated subframe 27 is pivotally and longitudinally adjustably connected to the main frame to constitute satellite vehicle 26. The subframe has two ends and is arranged ahead of rear swivel truck 4, in the operating direction, between the two successive, widely spaced undercarriages of the main frame. Respective undercarriages 28, 29 support the subframe ends, the illustrated undercarriages for support of the subframe being single-axle trucks. Rear undercarriage 29 of subframe 27 has its own brake means 9. This absorbs at least a portion of the braking force applied to the subframe at the beginning of each tamping cycle and keeps it away from the main frame whose continuous advance, therefore, is made even smoother. Universal joints pivotally connect the ends of longitudinally adjustable coupling device 30 to the elongated subframe and to the main frame, respectively, whereby the subframe moves with the main frame while being longitudinally adjusted in relation thereto, i.e. it stand still during each tamping cycle while the main frame continues to move on and is then moved to a forward position to catch up with the advanced main frame. The illustrated coupling device is a double-acting hydraulic cylinder-and-piston drive 31.

Standard tamping means 33 are mounted on subframe 27 between undercarriages 28, 29 for tamping ballast in intermittent tamping cycles under respective ties 6 at points of intersection of the two rails 5 and ties 6, the tamping means comprising respective tamping heads associated with the rails and vertically movable on the subframe by vertical adjustment drives 32, and the tamping heads carrying pairs of vibratory and reciprocatory tamping tools. Standard track lifting and lining means 34 associated with the two rails are also mounted on subframe 27 ahead of tamping means 33 in the operating direction and arranged on the subframe between undercarriages 28, 29. The track lifting and lining means comprises cooperating pairs of rail clamping rollers 35, flanged lining rollers 36, lifting drives 37 and lining drives 38, the lifting and lining drives being supported on subframe 27. The illustrated subframe comprises a carrier portion for tamping means 33 and track lifting and lining means 34, which is a spatial framework, and a beam-shaped portion projecting forwardly from the spatial framework carrier portion to front undercarriage 28, the illustrated beam-shaped portion being constituted by two parallel elongated carrier beams interconnected by one or more transverse braces. This construction of the subframe is particularly simple and uses the available space very economically. Coupling device 30 extends above the beam-shaped portion in the direction of the longitudinal extension of the machine. This arrangement makes excellent use of the available free space for the coupling device.

Such a machine, in which the main frame of the mother vehicle bridges over the subframe of the satellite vehicle, has all the advantages of conventional compact tampers advancing intermittently from tamping cycle to tamping cycle, despite its increased overall length. The machine has short connecting lines between the power plant and operating control means on the main frame and the operating drives on the subframe. The operator's cabs are so arranged that the operators have the operation as well as the track ahead and behind the machine well in sight for visually monitoring and controlling the operation of the tamping means and track lifting and lining means. The machine enjoys all the general advantages pointed out hereinabove. The increased length of the main frame makes it possible to increase the length of the reference lines correspondingly so that the leveling and lining errors are further decreased and the accuracy of the track correction is enhanced. The long wheelbase of the continuously advancing main frame improves the riding quality of the mother vehicle. Using swivel trucks for the widely spaced undercarriages of the main frame and single-axle undercarriages for support of the subframe makes it possible to use the machine in sharp curves while the individual axle loads are reduced since the weight of the machine is distributed over six axles. Since the tamping means is arranged on a rear half of the subframe, in the operating direction, the tamping means is immediately adjacent rear undercarriage 29 of the subframe. Therefore, the tamping tools will be centered over the associated rails even in sharp curves although the wheelbase of the satellite vehicle is relatively long.

Using standard tamping means and track lifting and lining means in the machine of the present invention make use of readily available equipment which has well withstood the test of time in track maintenance work. Mounting the operator's cab within range of the rear undercarriage of the subframe enables the operator readily and clearly to see the operation of the tamping means and to monitor and control the tamping operation as well as the intermittent advance of the subframe between successive tamping cycles. When one standard tamping head per rail with tamping units for the tamping of a single tie per tamping cycle is used as tamping means, a high-efficiency compact tamper is obtained.

Leveling and lining reference systems 19 and 23, whose leveling and lining references are arranged to move continuously with the main frame, comprise leveling and lining errors sensing element 39 mounted between the tamping means and the track lifting and lining means on the subframe for intermittent advance therewith, the sensing element comprising leveling sensor 40 and lining sensor 41 cooperating with the respective references. In this way, the machine uses standard and well tested reference systems, with the additional advantage of a longer reference base to reduce correction errors even further.

Since satellite vehicle 26 is independently supported on the track by undercarriages 28, 29, main frame 2 of mother vehicle 25 is free of its load and operating forces. They are, therefore, not transmitted to operator's cabs 10 and 13 on the main frame so that the operators and instruments in the cabs are not subjected to the vibrations and shocks involved in the track correction work.

The rear position of satellite vehicle 26 with respect to mother vehicle 25 is shown in broken lines in FIG. 1. In this position, wherein piston rod 42 linked for universal movement to subframe 27 is fully extended from cylinder-piston device 31 linked for universal movement o main frame 2, rear undercarriage 29 of satellite vehicle 26 subtends overhanging operator's cab 13. A safety distance remains between rear undercarriage 29 of the satellite vehicle and track sensing element 22 mounted immediately ahead of rear swivel truck 4 of the mother vehicle. This maximum end position of the satellite vehicle is reached only under special circumstances, for example if there is an unusual delay in completing the tamping cycle or if the forward speed of the continuously advancing mother vehicle is excessive. At the end of a tamping cycle, the satellite vehicle is rapidly advanced from its rear end position into the next working position shown in full lines, wherein tamping means 33 is centered above the next tie to be tamped, by applying hydraulic fluid pressure to one of the chambers of the cylinder of device 31. In this position, no pressure is applied to the cylinder chambers and brakes 9 are applied to the wheels of undercarriage 29 to hold the satellite vehicle in position for tamping. The track lifting and lining means are operated if the reference systems indicate a track position error and the tamping heads are lowered so that the pairs of tamping tools 43 are immersed in the ballast, with tie 6 positioned between the tools which are reciprocated and vibrated to tamp ballast under the tie. At the end of the tamping cycle, vertical adjustment drives 32 are actuated again to raise the tamping heads, brakes 9 are released from the wheels of undercarriage 29 and coupling 31 is operated to advance the satellite vehicle, thus effecting the intermittent movement indicated symbolically by arrows 44. Control 17 is suitably arranged to obtain an automatic sequence of the described operations so that the operator in cab 13 may concentrate primarily on the visual monitoring of the tamping operation. As is apparent from FIG. 1, main frame 2 has a minimum wheelbase L corresponding to wheelbase 1 of subframe 27 plus additional distance X provided for the intermittent advancement of the subframe from tamping cycle to tamping cycle. The subframe wheelbase is sufficient to permit vertical and horizontal bending of the track rails without undue stress thereon. Additional distance X depends on the tie spacing and the number of ties to be tamped in each tamping cycle. Coupling device 31 has a longitudinal adjustment path S sufficient to permit the intermittent advancement of the subframe. This wheelbase dimensioning not only meets all the requirements for the permissible deformation of the track rails during track correction but also takes full account of the proper coordination between the continuous advancement of the mother vehicle and the intermittent advancement of the satellite vehicle, giving the latter all the necessary freedom of movement between the undercarriages of the mother vehicle. Adjustment path S has a maximum length corresponding to the intermittent advancement of the subframe from tamping cycle to tamping cycle plus an additional path of the magnitude of about one average tie spacing, the additional path depending on the forward speeds of the main frame and subframe. This assures a trouble-free succession of the operating cycles of the machine without interruption of the continuous advancement of the main frame. The sum of free spaces A and B between undercarriages 28, 29 supporting the subframe ends and respectively adjacent swivel trucks 3, 4 supporting the main frame is at least equal to the maximum length of adjustment path S of the coupling device. This makes it possible to use the maximum length of the adjustment path under special operating conditions, for example if the completion of the tamping cycle is delayed due to heavy encrustation of the ballast, without the possibility of contact between adjacent undercarriages of the main frame and subframe. This prevents any premature disconnection of the main frame drive and stoppage of the mother vehicle in case of such operating delays as long as the tamping cycle has been completed before the maximum rear end position of the satellite vehicle has been reached. Furthermore, wheelbase 1 of the subframe is at least double distance C of track lifting and lining means 34 from rear undercarriage 29 of the subframe. It has a length corresponding at least to about 14 to 16 times average tie spacing X. If this is about 60 cm, for example, wheelbase 1 will have a length of about 8 m. This dimensioning of the subframe wheelbase in relation to the spacing of the track lifting and lining means from the rear undercarriage produces the advantageous results obtained in conventional track leveling and lining, i.e. relatively large rail correction movements are possible without unduly increasing the length of the satellite vehicle and, correspondingly, of the entire machine.

Figure 3:
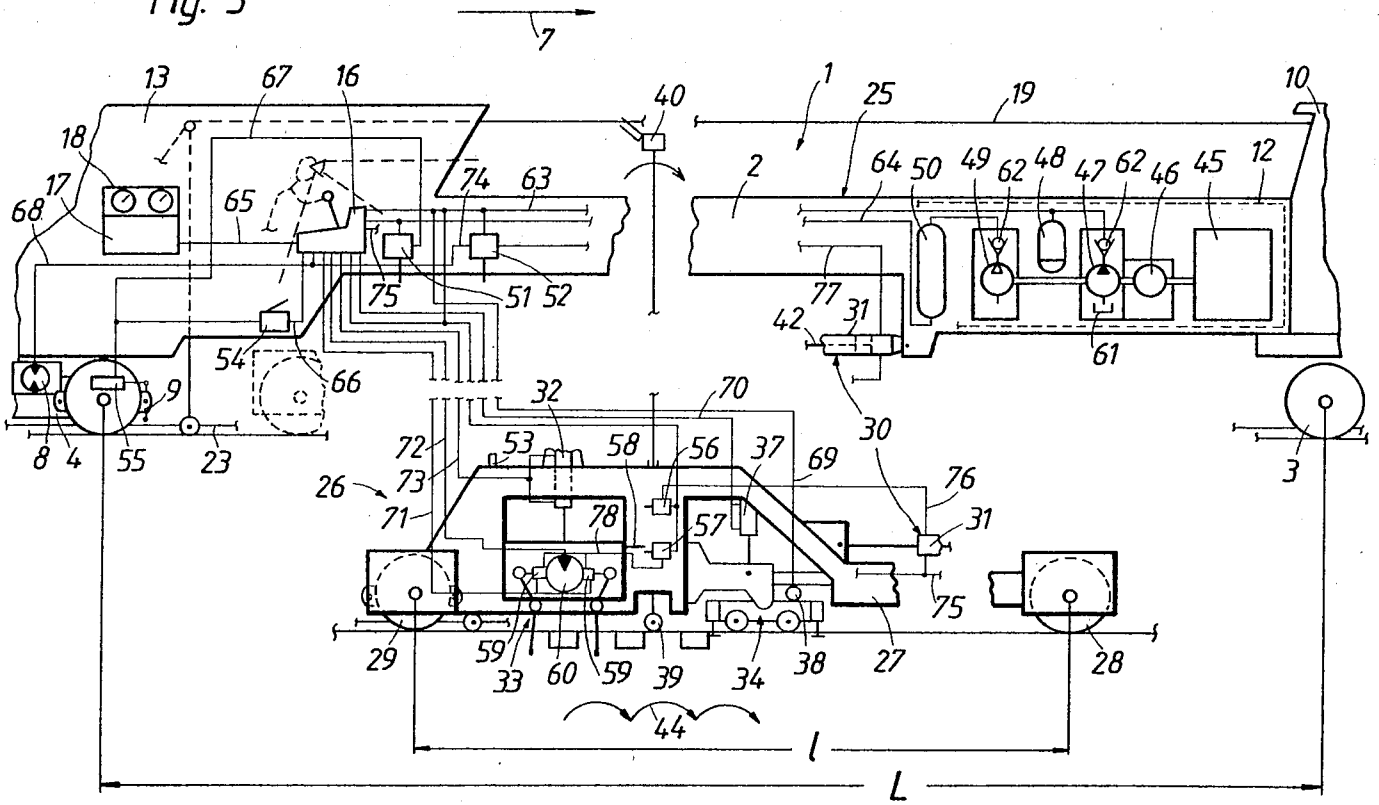
FIG. 3 is a schematically simplified, enlarged, fragmentary side view of the machine, showing the control lines leading from the operating control means on the main frame to the operated tools on the subframe, together with a greatly simplified control circuit diagram.

For a better understanding of the operating controls connecting satellite vehicle 26 to mother vehicle 25, FIG. 3 shows the two vehicles apart from each other at different levels. Power plant and operating control means 12 on the main frame comprises drive motor 45, for example a multi-cylinder diesel motor, generator 46 coupled to motor 45 for generating an electric current supply for the machine operation, a source of hydraulic fluid comprised of hydraulic fluid pump 47 connected to hydraulic fluid storage tank 48, and compressor 49 coupled to motor 45 and connected to compressed air storage tank 50. Two limit switches 51, 52 spaced in the operating direction are mounted on main frame 2 within the range of operator's cab 13 for cooperation with stop 53 on subframe 27. Furthermore, brake pedal 54 is arranged on the floor of operator's cab 13 for actuating pneumatically operated brake cylinders 55 of brake 9 on rear swivel truck 4. Two vertically superposed limit switches 56, 57 are arranged on subframe 27 in the path of vertical movement of each tamping head of tamping means 33 for cooperation with respective stop 58 on each tamping head. Reciprocating drive 59 and vibratory drive 60 operate the tamping tools in a conventional manner.

The control of the drives and brakes will now be described in connection with the simplified control circuit diagram shown in FIG. 3. Hydraulic fluid is removed from sump 61 by pump 47 and delivered through conduit 63 to drive and control panel 16, check valve 62 and pressure storage tank 48 being arranged in conduit 63. Compressed air reaches the drive and control panel from compressor 49 through compressed air conduit 64, check valve 62 and compressed air storage tank 50 being arranged in conduit 64. Limit switches 51, 52, 56 and 57 are mechanically operated valves also connected to conduit 63 for operation by the hydraulic fluid pressure in this conduit. Central control 17 and indicating instrumentation 18 are connected to drive and control panel 16 by a system of connections 65, which has been shown only diagrammatically. Respective flexible control connections extend from drive and operating panel 16 to the various drives of the machine. Hydraulic cylinder-and-piston drive 31 and the flexible connections constitute the only connection between the main frame and the subframe. All the drives are hydraulically operated. This assures not only full freedom of movement of the satellite vehicle in relation to the mother vehicle but also substantially isolates the two vehicles acoustically from each other, thus reducing the noise level on the mother vehicle during operation. Since all the drives are hydraulically and pneumatically operated, the entire operating structure is greatly simplified.

Brake pedal 54 operates a control valve between compressed air delivery conduit 64 and brake conduit 66 leading to brake cylinders 55. At the same time, these brake cylinders are connected by shunt line 67 to limit switch 51 constituted by a control valve to be able to be supplied with compressed air directly from conduit 64. Hydraulic fluid control conduits 68 to 73 connect control elements (not shown) on the drive and control panel to the various connected by shunt line 74 to limit switch 52 to receive hydraulic drives. Conduit 68 leads to hydraulic motor drive 8 of mother vehicle 25 for continuously advancing the mother vehicle in the operating direction and this drive is also connected by shunt line. 74 to limit switch 52 to receive hydraulic fluid pressure directly from conduit 63. Conduits 69 and 70 are respectively connected to the cylinder chambers of lining drives 38 and lifting drive 37. Conduits 71 and 72 lead to the respective cylinder chambers of reciprocating drives 59 and vibrating drive 60 of the tamping tools. Finally, conduit 73 leads to the cylinder chambers of vertical adjustment drives 32 of the tamping heads. Cylinder-and-piston coupling device 31 is connected to drive and control panel 16 by conduit 75. Alternatively, the cylinder chambers of device 31 are connected to limit switches 56 and 57 by conduits 76 and 77 to receive hydraulic fluid pressure directly from delivery conduit 63.

Referring to the above-described operating control circuit, track leveling, lining and tamping machine 1 operates in the following manner:

At the beginning of the operation, satellite vehicle 26 is advanced by drive 31 to a position wherein tamping tools 43 are properly centered above tie 6 to be tamped. The operator at drive and control panel 16 now actuates vibratory drive 60 for the tamping tools and any track position error is corrected automatically by control signals of reference systems 19, 23 operating lifting and/or lining drives 37, 38. Drive 32 is now actuated to lower the tamping heads of tamping means 33, stop 58 on each downwardly moving tamping head tripping respective limit switch 58 to cause hydraulic fluid to flow from conduit 78 into one of the cylinder chambers of reciprocating drives 59 whereby the tamping tools are pivoted towards the tie. Simultaneously with the lowering of the tamping heads, brakes 9 are released and drive 8 is actuated from drive and control panel 16 to impart the desired forward speed to the mother vehicle 25 for her continuous advancement during the subsequent operation. During the tamping cycle, satellite vehicle 26 remains in place, which is achieved either by actuating brakes 9 of rear undercarriage 29 and release of pressure from the cylinder chambers of longitudinally adjustable coupling device 31 or by delivering hydraulic pressure to one of these cylinder chambers to move piston rod 42 linked to subframe 27 in a direction opposite to the operating direction indicated by arrow 7. After the tamping cycle has been completed, i.e. when the ballast under tie 6 has been compacted to the desired density, drives 32 are again actuated to raise the tamping heads until stop 58 trips limit switch 56. This causes hydraulic fluid to be delivered to the other cylinder chamber of device 31 so that the satellite vehicle will be rapidly moved forwards to the position required for the next tamping cycle.

Limit switches 51 and 52 delimit the adjustment path of coupling device 31. When satellite vehicle 26 approaches the forward end position indicated in FIG. 3, stop 53 will trip limit switch 52 to supply additional hydraulic fluid through conduit 74 to hydraulic motor drive 8, this increasing its rpm and the forward speed of the mother vehicle. At the same time, hydraulic fluid is supplied to one of the cylinder chambers of device 31 and further backward movement of piston rod 42 is blocked before the satellite vehicle reaches its end position. However, if the completion of the tamping cycle is delayed and the satellite vehicle approaches this rear end position, stop 53 trips limit switch 51, causing compressed air to flow from conduit 64 to brake cylinders 55 whereby mother vehicle 25 is stopped. These controls may be actuated manually by an operator at panel 16 or may be effected automatically by central control 17 connected to the drive and control panel by connection 65.

Figure 4:
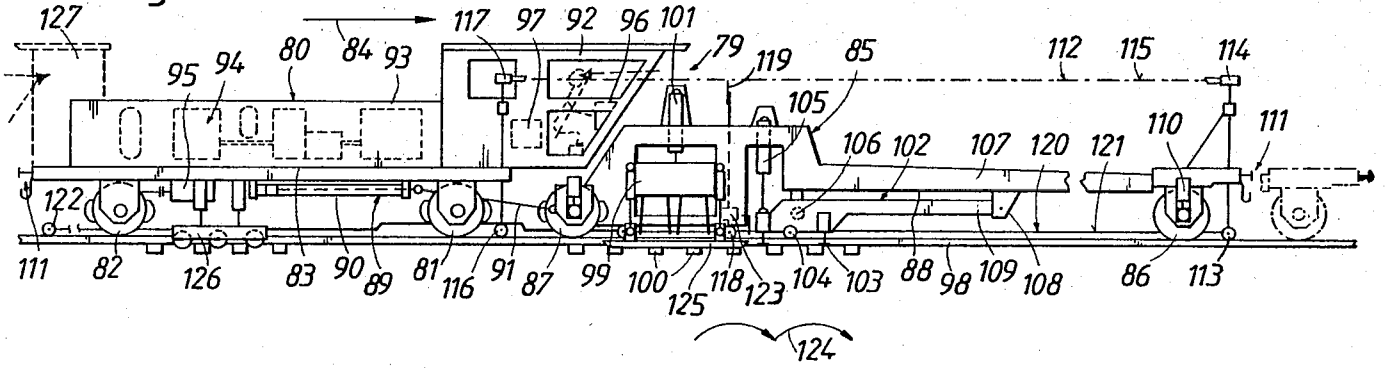
FIG. 4 is a view similar to that of FIG. 1 of another embodiment of the machine.
Figure 5:
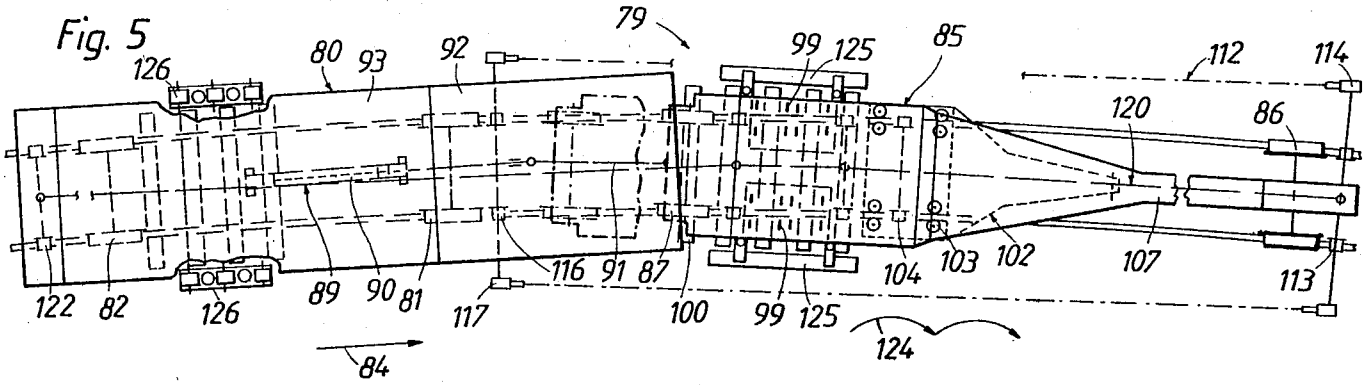
FIG. 5 is a view similar to that of FIG. 2 of this other embodiment.

FIGS. 4 and 5 illustrate mobile track leveling, lining and tamping machine 79 whose mother vehicle 80 has main frame 83 supported on undercarriages 81, 82 and the main frame has a forward portion overhanging front undercarriage 81. Elongated subframe 88 of satellite vehicle 85 precedes and partially subtends the forward main frame portion, in the operting direction indicated by arrow 84. The ends of the elongated subframe are supported on undercarriages 86, 87. Longitudinally adjustable coupling device 89 is a hydraulic cylinder-and-piston drive 90 extending below the forward main frame portion and the coupling device links the subframe to the main frame. The sequential arrangement of the mother and satellite vehicles provides an even longer reference base for the leveling and lining reference systems while the main frame may be shortened since it merely serves to carry the power plant and operating control means used to monitor and control the operations effected from the satellite vehicle. Such a compact mother vehicle, which is relatively short and light, may be supported on single-axle undercarriages, thus further simplifying the construction. The positioning of the coupling drive below the forward portion of the main frame makes effective use of the available space.

Operator's cab 92 is mounted on the overhanging forward main frame portion and operating control means at drive and control panel 96 or central automatic control 97 for the tamping means and the lining means are arranged in the cab. In this way, the operator in the cab has the operations of the tamping means in sight for monitoring the same and he may control all the operations of the machine. Power plant and operating control means 94 are arranged in box-shaped part 93 behind operator's cab 92 and forward drive 95 for the mother vehicle operates on rear undercarriage 82, which also has brake means (not shown). Tamping means 99 and track lifting and lining means 102 are mounted on elongated subframe 88. The tamping means comprises tamping heads 99 equipped with twin tamping units for the simultaneous tamping of two successive ties 100 and vertical adjustment drives 101 link the stamping heads to the subframe for lowering and raising the tamping heads. Track lifting and lining means 102 precedes tamping means 99 in the operating direction and comprises lifting rollers 103 pivotal to engage the rails, flanged lining rollers 104, and lifting and lining drives 105 and 106 linking the roller unit to the subframe. Elongated beam 107 is centered between the rails and projects forwardly from the spatial framework rear portion of the subframe, bracket 108 at the front end of the elongated beam serving to support centered elongated beam 109 of track lifting and lining means 102, the front end of beam 109 being linked to bracket 108. Undercarriages 86, 87 for subframe 88 have spring-supported axles and means 110 is arranged on the undercarriages for immobilizing the springs supporting the axles. This increases the accuracy of the track correction because it provides a rigid reference base for the track lifting and lining. As in the previously described embodiment, the tamping means, the track lifting and lining means as well as the reference systems controlling their operation are preferably standard equipment.

To enable the mother and satellite vehicles to be incorporated into, and coupled to, a standard railroad train, standard coupling devices 111 are arranged at the respective outer ends of main frame 83 and subframe 88. In this manner, it is possible to couple the vehicles to a regular freight train for transportation to a working site and also to couple auxiliary vehicles to the main frame and/or the subframe. If a separate forward drive is provided for the satellite vehicle, it will aid forward drive 95 when machine 79 moves over an ascending track section.

Illustrated leveling reference system 112 is an optical system operating with a respective light beam 115 associated with each rail 98, a respective light beam emitter 114 being mounted on track sensing element 113 in the corrected track section and light beam receiver 117 mounted on track sensing element 116 in the corrected track section next to operator's cab 92. Track sensing element 118 is mounted on satellite vehicle 85 between tamping means 99 and track lifting and lining means 102 and carries shadowboards 119 in the path of light beams 115. The illustrated lining reference system 120 comprises a rod arrangement 121 moving with satellite vehicle 85, the rod arrangement extending centrally between rails 98 and having a forward end carried by track sensing element 113 and a rear end carried by another track element 122 rearwards of rear undercarriage 92. Sensor 123 is connected to track sensing element 118 for measuring the ordinate of the track to determine any lining error. In this standard reference system , the reference lines move continuously with the mother vehicle but the leveling and lining control 118, with its shadowboards 119 and lining sensor 123, is associated with the tamping means 99 and track lifting and lining means 102 and moved intermittently with the satellite vehicle.

FIG. 4 shows the foremost end position of satellite vehicle 85 and FIG. 5 shows her rearmost end position. Only piston rod 91 of coupling device 89 and the flexible connections for control of the operating tools on the satellite vehicle connect the satellite and mother vehicles.

Shoulder surface ballast compactors 125 are linked to subframe 88 laterally adjacent the tamping heads to compact the ballast at the respective ends of the ties which have been tamped by tamping means 99. The surface ballast compactors are vertically adjustable by hydraulic drives and vertical vibrations may be imparted thereto. The surface compactors are lowered into contact with the ballast simultaneously with the lowering of the tamping heads so that they are operated intermittently during each tamping cycle. Further roller compactors 126 are vertically adjustably mounted at the rear of mother vehicle 80 for further continuously compacting the ballast along the ends of the ties as the mother vehicle advances in the operating direction. The roller compactors are comprised of a plurality of vertically loaded, vibratory rollers rotating about transversely extending axes. This additional shoulder compaction of the ballast may be selectively used for improving the quality of the ballast compaction and providing an even more uniform compaction of the ballast areas adjacent the track, thus enhancing the durability of the track correction.

The continuous drive of the mother vehicle in the operating direction indicated by arrow 84, the intermittent drive of the satellite vehicle symbolized by arrows 124 and the control of the operating tools on the satellite vehicle proceeds in the same manner as been described hereinabove in connection with FIG. 3. As schematically indicated in broken lines in FIG. 4, additional operator's cab 127 may be mounted at the rear end of the main frame, particularly for use by a driver during movements of the machine between working sites. While specific embodiments have been described and illustrated, the form and structure of the motor and satellite vehicles may be varied, as may be the drives and brakes. Also, various suitable controls may be used, including remote-controlled solenoid valves and the like.

What is claimed is:

1. A mobile machine for leveling, lining and tamping a track consisting of two rails fastened to successive ties resting on ballast, which comprises (a) a main frame supported on undercarriages for continuous movement in an operating direction, (b) a power plant and operating control means carried by the main frame, (c) an elongated subframe pivotally and longitudinally adjustably connected to the main frame, the subframe having two ends and being arranged ahead of one of the undercarriages supporting the main frame, in the operating direction, and (1) respective undercarriages supporting the subframe ends, (d) tamping means mounted on the subframe between the respective undercarriages for tamping ballast in intermittent tamping cycles under respective ones of the ties at points of intersection of the two rails and the respective ties, (e) track lifting and lining means associated with the two rails mounted on the subframe ahead of the tamping means at a fixed distance therefrom in the operating direction and being arranged on the subframe between the respective undercarriages, (1) the subframe having a wheelbase which is at least double the distance of the track lifting and lining means from a respective one of the undercarriages supporting a rear one of the subframe ends, in the operating direction, the wheelbase having a length corresponding at least to about 14 to 16 times the average tie spacing, (f) track leveling and lining reference systems associated with the track lifting and lining means, and (g) a longitudinally adjustable coupling device pivotally connecting the elongated subframe to the main frame whereby the subframe moves with the main frame while being longitudinally adjusted in relation thereto.

2. The mobile track leveling, lining and tamping machine of claim 1, wherein the main frame is supported by two successive and widely spaced ones of said undercarriages and the elongated subframe is arranged between the widely spaced undercarriages of the main frame.

3. The mobile track leveling, lining and tamping machine of claim 1, wherein the widely spaced undercarriages of the main frame are swivel trucks and the two undercarriages supporting the subframe are single-axle trucks.

4. The mobile track leveling, lining and tamping machine of claim 1, wherein the tamping means is arranged on a rear half of the subframe, in the operating direction.

5. The mobile track leveling, lining and tamping machine of claim 1, wherein the main frame has a minimum wheelbase corresponding to the wheelbase of the subframe plus an additional distance provided for the intermittent advancement of the subframe from tamping cycle to tamping cycle, the subframe wheel base being sufficient to permit vertical and horizontal bending of the track rails without undue stress thereon, the additional distance depending on the tie spacing and the number of ties to be tamped in each tamping cycle and the coupling device having a longitudinal adjustment path sufficient to permit the intermittent advancement of the subframe.

6. The mobile track leveling, lining and tamping machine of claim 5, wherein the longitudinal adjustment path of the coupling device has a maximum length corresponding to the intermittent advancement of the subframe from tamping cycle to tamping cycle plus an additional path of the magnitude of about one average tie spacing, the additional path depending on the forward speeds of the main frame and the subframe.

7. The mobile track leveling, lining and tamping machine of claim 5, wherein the sum of the free spaces between the undercarriages supporting the subframe ends and the respectively adjacent undercarriages supporting the main frame is at least equal to the adjustment path of the coupling device.

8. The mobile track leveling, lining and tamping machine of claim 1, wherein only the coupling device and flexible connections between the operating control means on the main frame and operating means controlled thereby on the subframe connect the main frame and the subframe.

9. The mobile track leveling, lining and tamping machine of claim 1, wherein the power plant comprises a source of hydraulic fluid, the coupling device is a hydraulic cylinder-and-piston drive and hydraulic drives on the subframe actuate the tamping means and the track lifting and lining means, and further comprising flexible conduits connecting the drives to the hydraulic fluid source.

10. The mobile track leveling, lining and tamping machine of claim 1, wherein the subframe comprises a carrier portion for the tamping means and the track lifting and lining means, the carrier portion being a spatial framework, and a beam-shaped portion projecting forwardly from the spatial framework.

11. The mobile track leveling, lining and tamping machine of claim 10, wherein universal joints connect the coupling device to the main frame and the subframe, and the coupling device extends above the beam-shaped portion in the direction of the longitudinal extension of the machine.

12. The mobile track leveling, lining and tamping machine of claim 1, further comprising a separate drive for moving the subframe in the operating direction.

13. The mobile track leveling, lining and tamping machine of claim 1, further comprising separate brake means for the main frame and the subframe.

14. The mobile track leveling, lining and tamping machine of claim 1, wherein the main frame has a forward portion overhanging a front one of the undercarriages supporting the main frames the subframe preceding and partially subtending the forward main frame portion, in the operating direction.

15. The mobile track leveling, lining and tamping machine of claim 14, further comprising an operator's cab mounted on the forward main frame portion, the operating control means comprising controls for the tamping means and the track lifting and lining means arranged in the cab.

16. The mobile track leveling, lining and tamping machine of claim 14, wherein the longitudinally adjustable coupling device is a hydraulic cylinder-and-piston drive extending below the forward main frame portion.

17. The track leveling, lining and tamping machine of claim 14, further comprising coupling devices at respective outer ends of the main frame and the subframe, the coupling devices enabling the main frame and subframe to be coupled to a standard railroad train.

18. The track leveling, lining and tamping machine of claim 1, wherein the leveling and lining reference systems respectively comprise leveling and lining references arranged to move continuously with the main frame and to cooperate respectively with a leveling and lining error sensing element advancing intermittently with the subframe.

19. The track leveling, lining and tamping machine of claim 1, further comprising an operator's cab mounted on the main frame for visually monitoring and controlling the operation of the tamping means and track lifting and lining means.

20. The track leveling, lining and tamping machine of claim 19, wherein the operator's cab is mounted on the main frame within the range of a rear one of the undercarriages supporting the subframe, in the operating direction.

* * * * *